US006605208B2

(12) United States Patent
Hucker et al.

(10) Patent No.: US 6,605,208 B2
(45) Date of Patent: Aug. 12, 2003

(54) PROCESS FOR REDUCTION OF EMISSIONS IN ASPHALT PRODUCTION

(75) Inventors: Kenneth Hucker, Aransas Pass, TX (US); Sanford P. Brass, 13519 Sundowner, Houston, TX (US) 77041

(73) Assignee: Sanford P. Brass, Houston, TX (US)

( * ) Notice: Subject to any disclaimer, the term of this patent is extended or adjusted under 35 U.S.C. 154(b) by 0 days.

(21) Appl. No.: 10/003,607

(22) Filed: Nov. 2, 2001

(65) Prior Publication Data

US 2002/0053531 A1 May 9, 2002

Related U.S. Application Data

(60) Provisional application No. 60/245,513, filed on Nov. 3, 2000.

(51) Int. Cl.[7] ..... C10C 1/04; B01D 3/06; B01D 3/10

(52) U.S. Cl. ..... 208/361; 208/41; 208/43; 208/352; 208/355; 208/357; 208/366; 196/114; 196/127

(58) Field of Search ..... 208/41, 42, 43, 208/347, 350, 352, 354, 355, 361, 366, 356, 357, 358; 196/114, 127

(56) References Cited

U.S. PATENT DOCUMENTS

| | | | | | |
|---|---|---|---|---|---|
| 1,842,105 | A | | 1/1932 | Loomis | 208/41 |
| 2,847,359 | A | | 8/1958 | Beuther et al. | 196/50 |
| 3,617,502 | A | * | 11/1971 | Stolfa et al. | 208/89 |
| 3,951,781 | A | * | 4/1976 | Owen et al. | 208/86 |
| 3,989,616 | A | * | 11/1976 | Pagen et al. | 208/6 |
| 4,082,653 | A | * | 4/1978 | DeGraff | 208/251 R |
| 4,087,354 | A | * | 5/1978 | Hessler | 208/251 R |
| 4,259,170 | A | * | 3/1981 | Graham et al. | 208/33 |
| 4,265,731 | A | * | 5/1981 | Mitchell | 208/80 |
| 4,622,130 | A | * | 11/1986 | Stem | 208/87 |
| 4,994,168 | A | * | 2/1991 | Harandi | 208/19 |
| 5,124,027 | A | * | 6/1992 | Beaton et al. | 208/309 |
| 5,728,291 | A | * | 3/1998 | Miller et al. | 208/45 |

FOREIGN PATENT DOCUMENTS

| | | | |
|---|---|---|---|
| WO | WO 96/11242 | 4/1996 | C10C/3/00 |

* cited by examiner

*Primary Examiner*—Walter D. Griffin
*Assistant Examiner*—Tam M. Nguyen
(74) *Attorney, Agent, or Firm*—Bracewell & Patterson LLP

(57) ABSTRACT

A process and apparatus are disclosed that relate generally to a process for reducing harmful or unwanted emissions during the production of asphalt, such as blue smoke. The process includes the introduction of a pump around of the wax oil fraction for re-introduction into the vacuum tower. Additional desirable features include stripping trays below the wax oil collection tray and the feed zone. The result is to produce an asphalt product that creates less blue smoke in the hot mix plant. Another desirable feature is that a product can be created that meets Performance Grade specifications with the addition of polymers or other additives.

9 Claims, 7 Drawing Sheets

PROCESS FOR REDUCTION OF EMISSIONS IN ASPHALT PRODUCTION

This application claims priority from U.S. Provisional Patent application Ser. No. 60/245,513, filed Nov. 3, 2000 by Kenneth Hucker and Sanford P. Brass, entitled Process for Reduction of Emissions in Asphalt Production.

BACKGROUND OF THE INVENTION

1. Field of the Invention

The present invention relates generally to a process for reducing harmful or unwanted emissions during the production of asphalt.

2. Description of the Prior Art

Vacuum tower operation for the production of asphalt binder requires the reintroduction of heavy vacuum gas oil ("HVGO") to reduce entrainment and metals in the HVGO product. HVGO is reintroduced to the tower below the HVGO tray. A portion of the HVGO that is introduced below the tray is not vaporized and therefore survives to become part of the asphalt binder. The HVGO portion which survives increases the emissions when the asphalt binder is processed with aggregates in a hot mix plant. It is an objection of the invention to provide a process and apparatus that creates an asphalt binder which will produce decreased emissions when processed at a hot mix plant.

In order to avoid emissions and meet performance specifications, it is known in the art to add polymeric additives to the asphalt. The cost of these additives can be substantial. It is an object of the current invention to provide a process and apparatus for creating an asphalt binder that minimizes blue smoke without the addition of polymers. Blue smoke is defined or discussed in EPA guidance document AP 42 regarding emissions.

The American Association of State Highways and Transportation Organization (AASHTO) sets specifications for asphalts used in the paving industry. It is an object of the current invention to provide a process and apparatus for creating an asphalt binder that conforms to the AASHTO MP-1 performance specifications without the addition of polymers. Such asphalts are referred to as modified asphalts by virtue of its process.

Entrainment of heavy metals in gas oil vapors is problematic in the operation of such vacuum towers. It is an object of the current invention to reduce entrainment of heavy metals in the vacuum tower during the processing of asphalt.

SUMMARY OF THE INVENTION

The present invention is a method for reducing harmful or unwanted emissions during the production of asphalt. More specifically, the process reduces the production of "blue smoke" when the asphalt binder is combined with aggregates in the hot mix plant. This "blue smoke" is formed as a result of light ends or fractions which remain in the asphalt binder after processing in a vacuum unit. These light ends are released when the binder is heated in the hot mix plant. An alternate embodiment also reduces the amounts of entrained metals.

The "pump around" process of the current invention is used in the manufacture of asphalt binder and in conjunction with a vacuum tower or unit. The vacuum tower typically includes an HVGO tray or other middle distillate oil tray and an asphalt collector. By installing a collector tray between a middle distillate oil tray and an asphalt collector, a fractional cut of the material present between the trays is collected or removed from the vacuum tower and further processed before reintroduction into the system. The fractional cut or "wax oil" fraction is one of the cuts produced from the vacuum tower.

The current invention includes a process for separating a feed crude into fractional products that meet one or more of the above-identified objectives. The process includes feeding the feed crude into a pre-flash vessel to produce an overhead light ends product and a liquid flashed crude feed. The flashed crude feed is introduced into a heater to produce a partially vaporized crude feed. This partially vaporized crude feed is fed into a feed zone of a vacuum tower. From the vacuum tower is produced an overhead vapor stream, a middle distillate oil fraction, a wax oil fraction, and a bottoms asphalt product. The feed zone is located below a wax oil collection tray that collects essentially all liquids on the wax oil collection tray such that they are removed from the tower as the wax oil fraction. At least a portion of the wax oil fraction is heated and fed back into the feed zone. This process produces bottoms asphalt product that meets the performance specification desired.

An alternate embodiment includes introducing the portion of the heated wax oil fraction into a second flash vessel prior to introduction into the feed zone. Where the pre-flash vessel and the second flash vessel are used, one is typically under pressure while the other is under vacuum.

Another alternate embodiment includes feeding the wax oil fraction into the heater in combination with the liquid flashed crude feed. While the wax oil fraction is heated until it is essentially all vapor before reintroduction into the vacuum tower, the flashed crude feed is introduced in mixed phase.

Another embodiment includes feeding the wax oil fraction into the pre-flash vessel in combination with the feed crude such that the wax oil fraction is subjected to an additional vapor-liquid equilibrium separation prior to introduction into the feed zone of the vacuum tower.

It has been found that these embodiments of the current invention, while useful with many crude, provide particular advantage when the crude feed is Boscan Crude or Altimira Crude. The resulting product of this invention is the production of asphalt product that meets the specification for Performance Grade 76-22 conforming the AASHTO MP-1 specification. The asphalt product meets this specification without the addition of polymers or other additives. In this manner, the asphalt bottoms produced by all embodiments of this invention provide superior qualities even when the asphalt product is "neat" or without additives. Alternately, Performance Grade 70-28 or other desirable modified asphalts can be produced by virtue of the process that is one embodiment of the invention.

Heat can be added to the vacuum tower through traditional means such as through introducing steam into a bottom stripping section of the vacuum tower. Alternately, a reboiler or other traditional heat sources can be used to add heat to the stripping section of the vacuum tower.

A further alternate includes pumping a portion of the middle distillate oil fraction to a location in the vacuum tower above the middle distillate oil collection tray, referred to as a "pump up." The middle distillate oil collection tray collects essentially all liquids on the middle distillate oil collection tray into the middle distillate oil fraction.

The invention also includes an apparatus designed for practicing this process. The apparatus for separating the feed crude into fractional products includes the pre-flash vessel to receive and separate the feed crude into overhead light ends product and liquid crude feed. The heater heats the liquid flashed crude feed to produce the partially vaporized crude feed. The vacuum tower has a feed zone to receive the partially vaporized crude feed. The feed zone is located below the wax oil collection tray, which collects essentially all liquids as a wax oil fraction. The asphalt product is removed from the bottom of the tower. The pump receives at least the portion of the wax oil fraction and introduces the portion of wax oil fraction into the feed zone.

In an alternate embodiment of the apparatus, the pump moves the portion of the wax oil fraction into the heater prior to the wax oil fraction portion being introduced in combination with the partially vaporized crude feed to the feed zone.

In another alternate embodiment of the apparatus, the pump moves the portion of the wax oil fraction into the pre-flash vessel in combination with the feed crude such that the wax oil fraction portion is flashed then heated prior to introduction into the feed zone.

Alternately, a second flash vessel receives the portion of the wax oil fraction prior to introduction of the portion of wax oil fraction into the feed zone. When the second flash vessel is used, this flash vessel is typically maintained at a different pressure than the pre-flash vessel.

The vacuum tower includes a bottom stripping section below the feed zone and has means for introducing steam to the bottom stripping section. Side to side stripping trays can be used below the wax oil collection tray and the feed zone to further reduce light components in the asphalt product. Other heating sources, such as reboilers and the like, can be used in place of or in addition to the means for introducing steam, also called steam stripping means.

In an alternate embodiment, the vacuum tower also includes the middle distillate oil collection tray. A pump-around pumps at least the portion of the middle distillate oil fraction to a location in the vacuum tower above the middle distillate oil collection tray, essentially all liquids on the middle distillate oil collection tray being collected into the middle distillate oil fraction.

This process and apparatus allow the heater to be run at a higher temperature which, in effect, reduces the amount of light ends left in the asphalt binder. In this way the entire process is continuous. By combining the wax oil with the crude feed prior to introduction to the vacuum unit, entrainment and metal contamination can be greatly reduced. Additionally, an asphalt binder is created which will produce fewer emissions when undergoing further processing.

DETAILED DESCRIPTION OF THE PREFERRED EMBODIMENT

Figure 1:
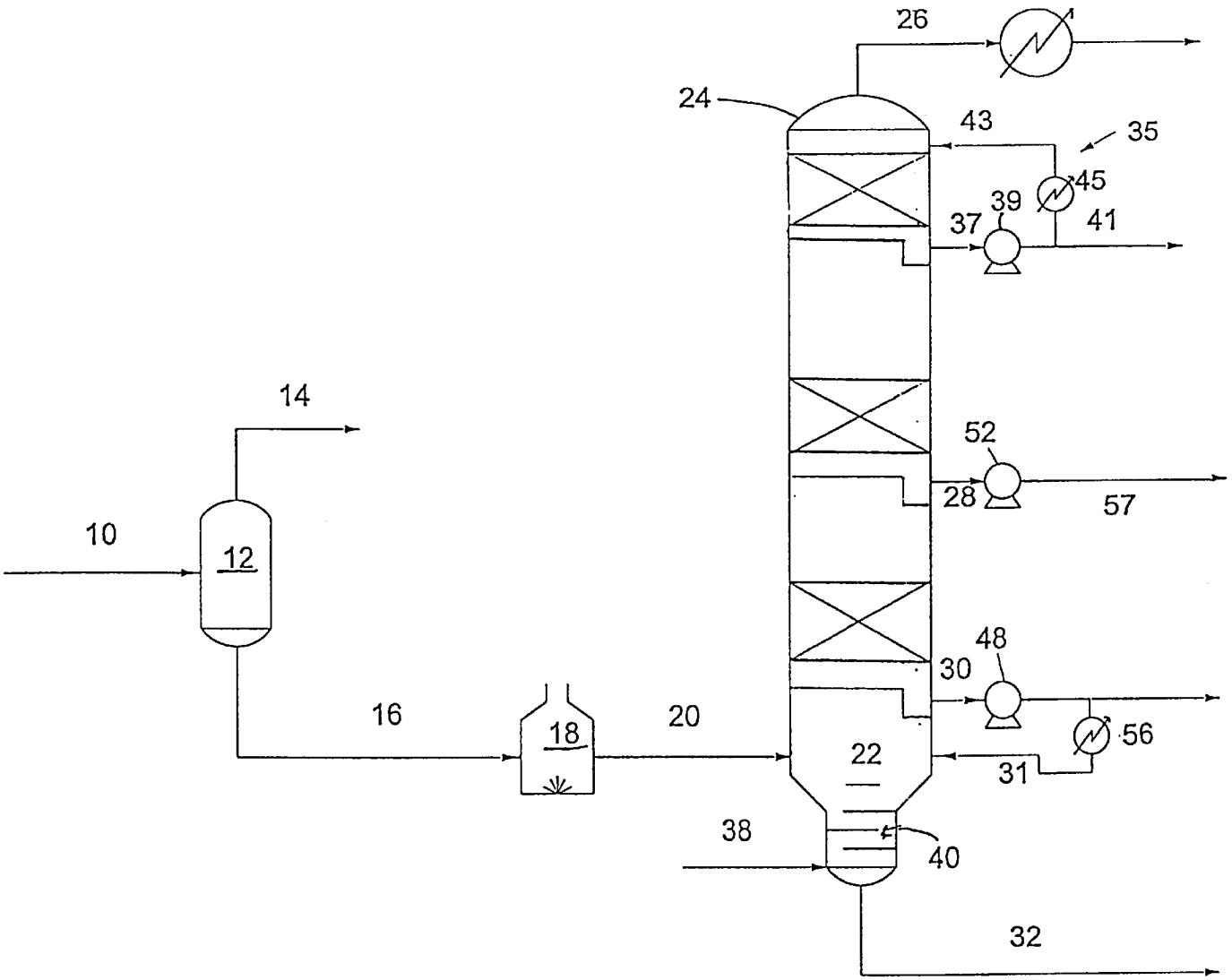
FIG. 1 is a schematic of a system incorporating the pump around process of the invention

FIG. 1 shows a schematic demonstrating an embodiment of the process and apparatus for separating a feed crude into fractional products incorporating the pump around of the current invention. Feed crude 10 is fed or pumped into pre-flash vessel 12 to produce an overhead light ends product 14 and a liquid flashed crude feed 16 while removing water. The overhead light ends product 14 can be collected in any suitable manner. The feed crude 10 can be heated, such as through the use of a series of shell and tube exchangers, such that the flashing of the feed crude occurs at a desired temperature. After removal from of the liquid flashed crude feed 16 from pre-flash vessel 12, flashed crude feed 16 is introduced to heater 18 to produce partially vaporized crude feed 20. Heater 18 is any heater traditional in the art such as a fired heater or any other charge or process heater. Partially vaporized crude feed 20, in turn, is fed into feed zone 22 of vacuum tower 24. Steam 38 or heat from a traditional source is added into a bottom stripping section 40 of the vacuum tower 24 to further separate the feed into fractions. The products from the vacuum tower 24 include an overhead vapor stream 26, a middle distillate oil fraction 28, a wax oil fraction 30, and a bottoms asphalt product 32. Feed zone 22 is located below wax oil collection tray 34 in the lower section of the column. Wax oil collection tray 34 is a liquid-draw or total draw tray that collects essentially all of the liquid on the tray to draw it off as wax oil fraction 30. This type of tray will trap or collect all liquids and thereby prevent such liquids from traveling or falling back down the tower. Pump 48 receives the wax oil fraction 30 and introduces the portion of wax oil fraction 30 into the feed zone 22. At least a portion 31 of the wax oil fraction 30 is subject to heat exchange in wax oil heat exchanger 56 and fed back into feed zone 22. An optional bypass (not shown) is available to bypass the cooler. In this configuration, middle distillate oil fraction 28 can be passed through a series of heat exchangers and then to a storage tank or similar storage area or treated in other manners traditional in the art. Additional side draws can be removed as desired.

A liquid source exists at the top of the vacuum tower and can be one or more of any traditional methods of providing liquid to the top of the tower. Examples of such sources include reflux from partial or total condensers or introduction of a top feed stream. FIG. 1 demonstrates another embodiment through the use of a top pump-around 35. In this configuration, a liquid draw 37 is pumped by pump 39. A portion of liquid draw 37 can be taken as a product stream 41. At least a portion of liquid draw stream 37 is fed to heat exchanger 45 and returned to the vacuum tower as top return 43.

The asphalt product created by this process contains fewer light ends and thus produces less blue smoke. Boscan Crude and Altimira Crude are preferred feeds for production of Performance Grade 76-22 without the need for the addition of additives. Thus, the asphalt is modified by virtue of its process. The ability to create performance grade asphalt without the need to add polymers translates into substantial cost savings. Also, the resulting asphalt product is environmentally friendly. The benefit of meeting the performance grade without the addition of polymers provides not only a cost benefit, but allows the resulting product to be laid cooler thus further reducing emissions.

Figure 6:
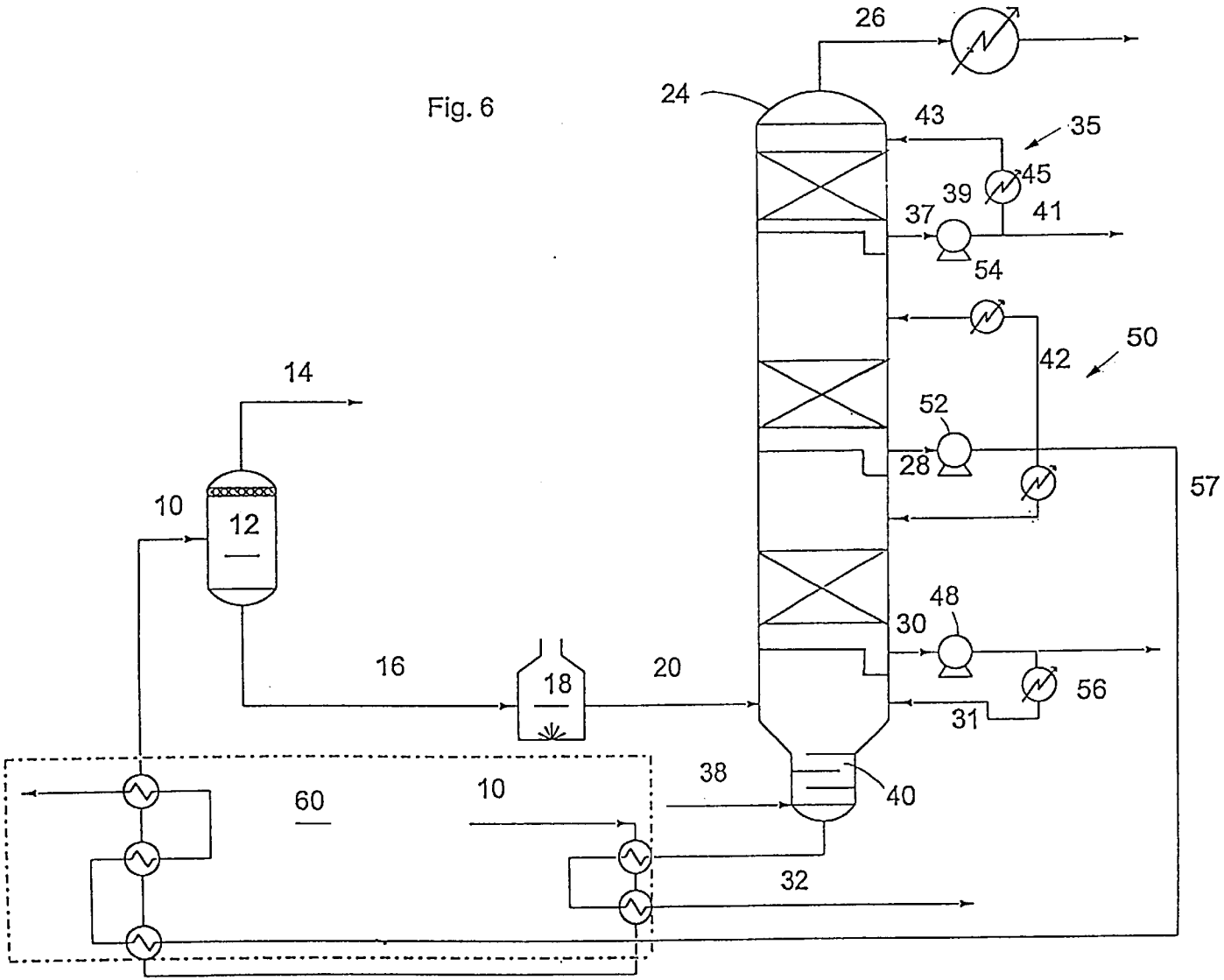
FIG. 6 demonstrates an alternate embodiment of the invention including a heat train.

Notably, the same crudes processed by prior art methods were very difficult to process due to the high viscosity of the feed crude. FIG. 6 demonstrates heat or feed train 60.The addition of heat exchanger 56 and pump 48 that allows for the reintroduction of wax oil fraction into the vacuum tower creates more heat thus reducing viscosity in the feed train 60. Increased heat reduces the viscosity of the crude alleviating the difficulties inherent in highly viscous crudes in shell and tube exchangers. The benefit of being able to process these crudes without the difficulties associated with high viscosity crudes in the feed train is substantial.

One example of the asphalt product of this invention is where the overflash material separated from the vacuum tower bottoms boils in the range of about 995 degrees F. at the 5% point and 1198 degrees F. at the 95% point.

The asphalt product created by the process of the invention was the subject of a study by the Federal Highway Administration in which the asphalt product modified by virtue of the process of the invention was compared to polymer-modified asphalt binders. The objective of the study was to evaluate the performance of mixtures with close Performance Grades but with varied chemistries. Surprising results were obtained indicating that the asphalt product resulting from the process of the invention meets performance grade without the expected addition of polymers and includes other chemical properties and characteristics considered beneficial.

The asphalt product removed can pass through one or more heat exchangers as desired prior to collection or storage. Prior to collection, the asphalt fraction is injected with steam to further vaporize any lighter fractions contained within the binder fraction. More preferably, the asphalt product is passed through several side to side steam stripping trays as shown in stripping section 40 prior to collection. Removal of the lighter fractions from the asphalt will result in collection of some of these relatively lighter fractions on the wax oil collection tray.

Figure 2:
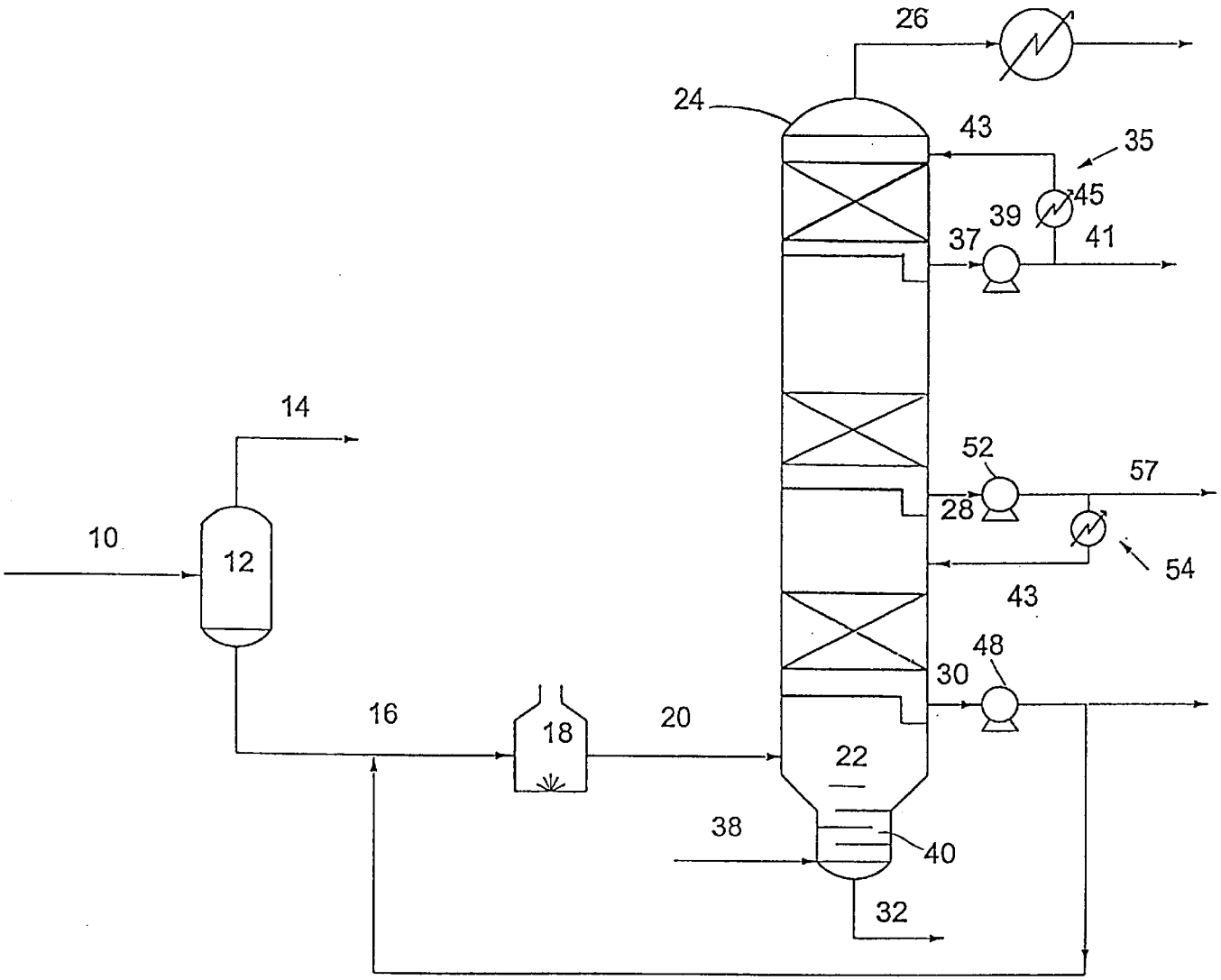
FIG. 2 is an alternate embodiment of the current invention feeding at least part of the wax oil fraction into the pre-flash vessel in combination with the feed crude.

FIG. 2 is a schematic of an alternate embodiment indicating that the portion of the wax oil fraction 30 is fed into the heater 18 in combination with the liquid flashed crude feed 16 before the combined stream enters the feed zone 22 of the vacuum tower.

Figure 3:
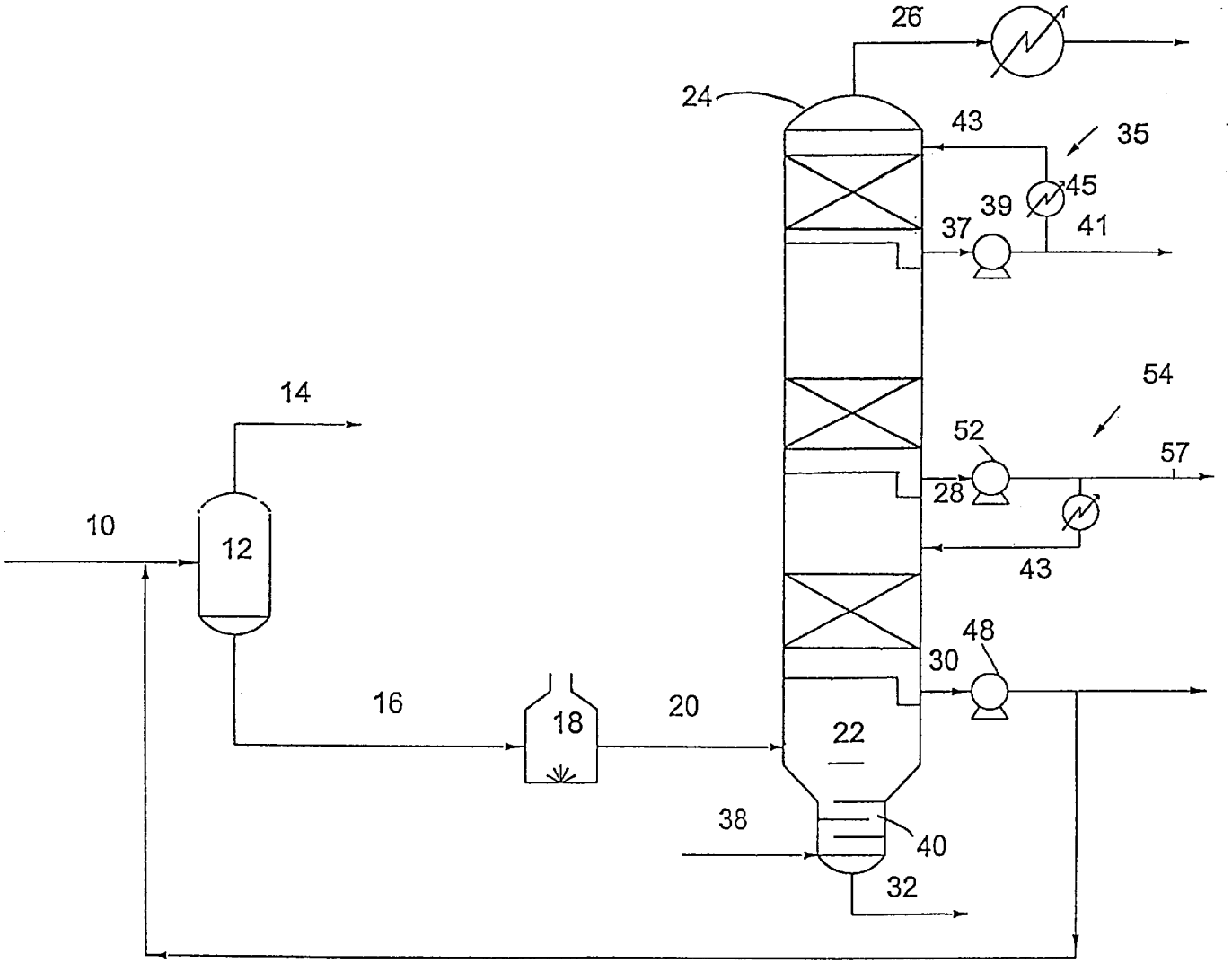
FIGS. 3 and 3*a* are alternate embodiments of the current invention where the portion of the wax oil fraction is fed to the pre-flash vessel in combination with the feed crude.
Figure 3A:
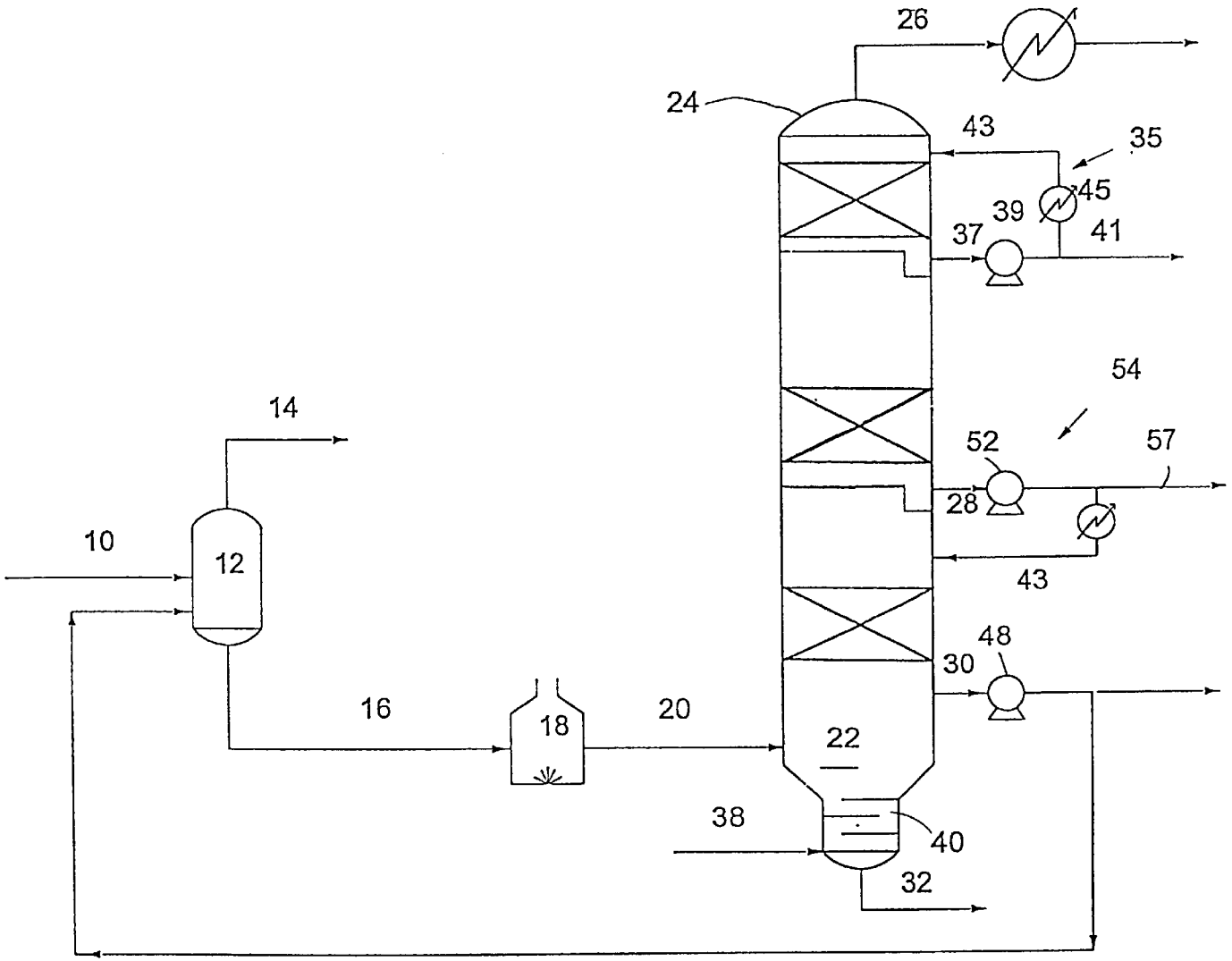

FIGS. 3 and 3*a* are schematics demonstrating an embodiment in which the portion of the wax oil fraction 30 is fed into the pre-flash vessel 12 in combination with the feed crude 10. FIG. 3 shows feed crude 10 being mixed with wax oil fraction 30 prior to introduction into pre-flash 12. FIG. 3*a* shows feed crude 10 and wax oil fraction 30 entering the pre-flash without advance mixing. An alternate embodiment includes the addition of pump-down 54 that pumps a portion 43 of the middle distillate oil fraction 28 to a location in the vacuum tower 24 below middle distillate oil collection tray 44. Any middle distillate oil not returned to the tower is drawn off as product stream 57.

Figure 4:
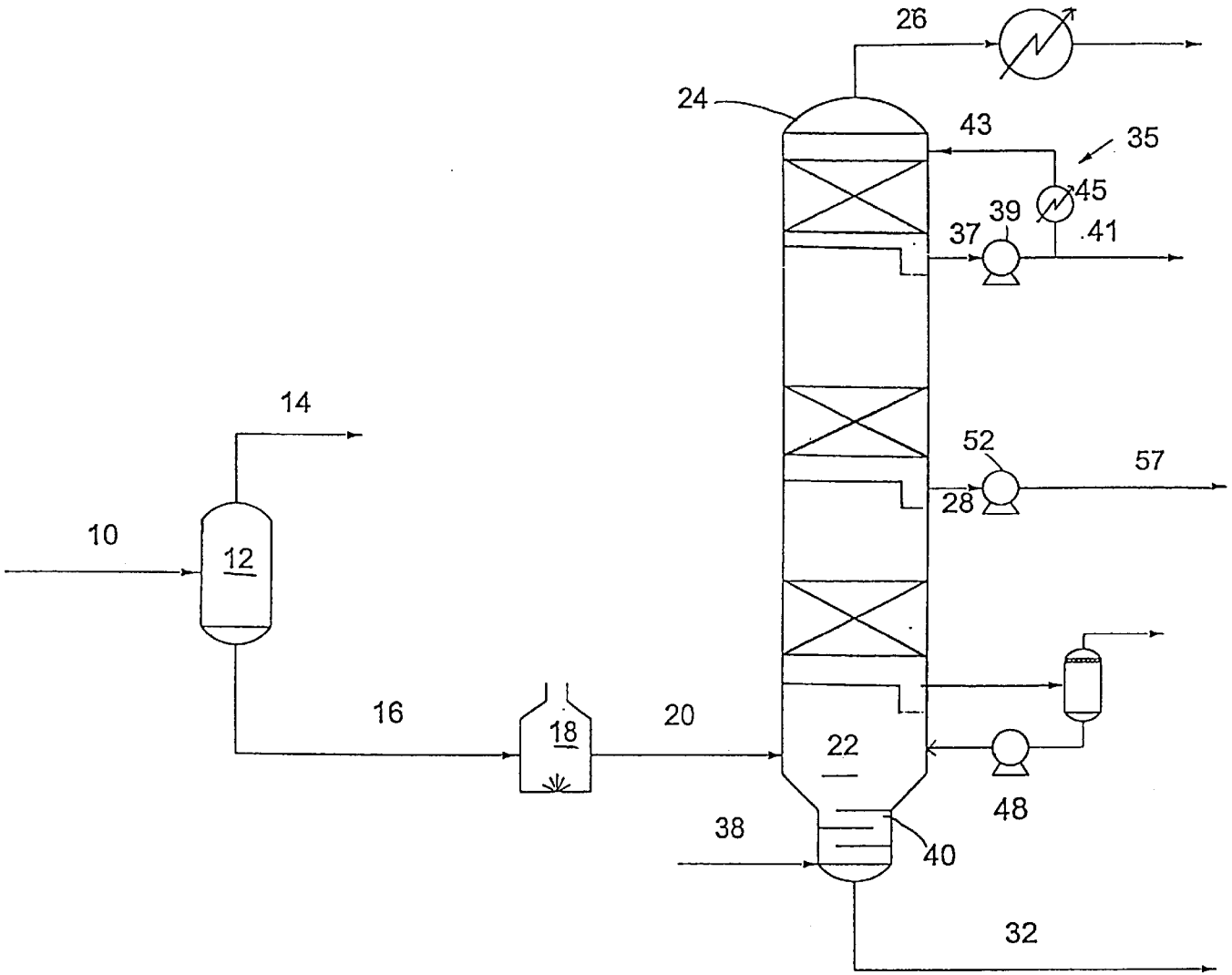
FIG. 4 is yet another embodiment of the invention with the portion of the heated wax oil fraction being introduced into a second flash vessel prior to re-introduction into the feed zone.

FIG. 4 is a schematic of another embodiment where the portion of the heated wax oil fraction 30 is fed into second flash vessel 36 prior to re-introduction into the feed zone 22.

Figure 5:
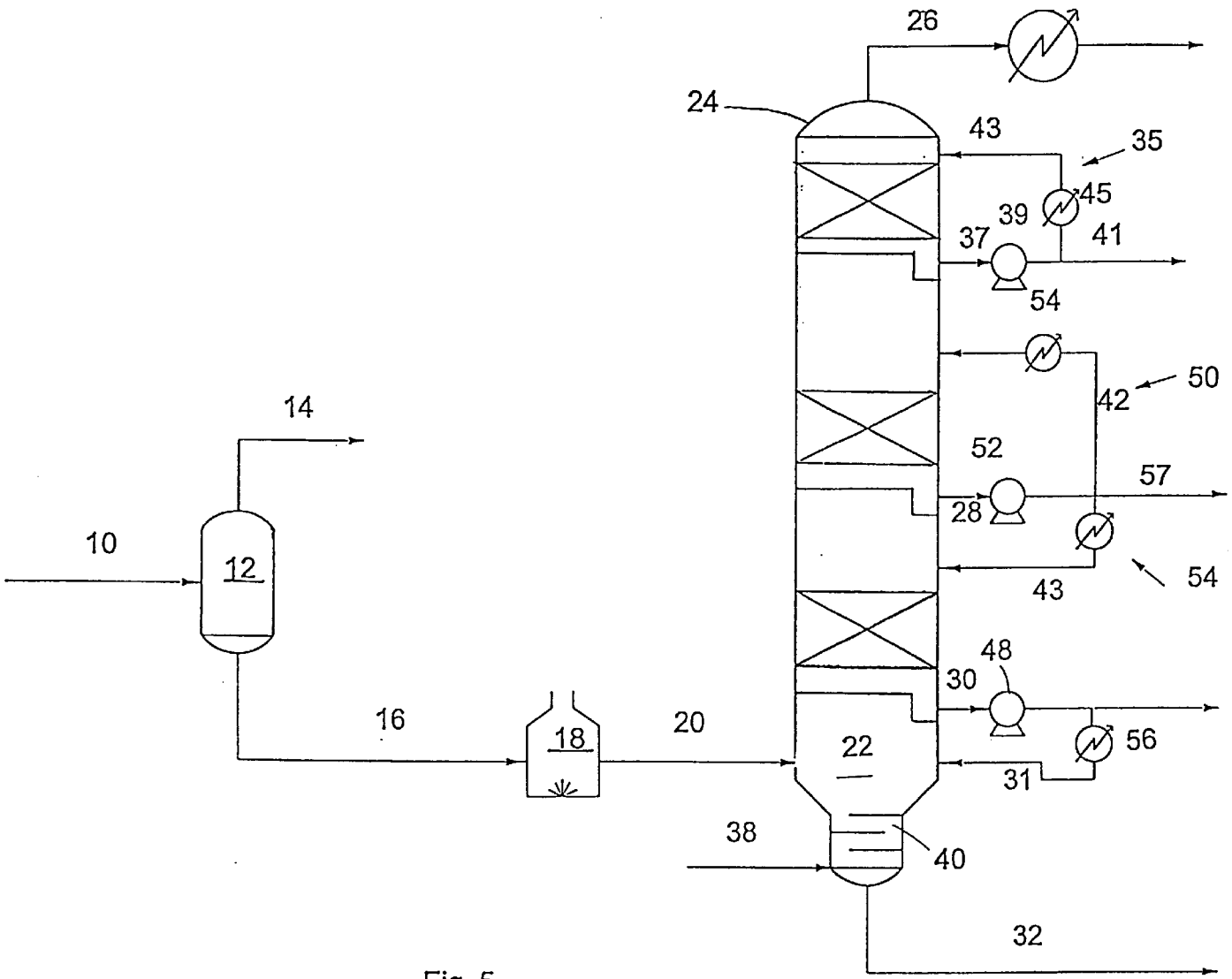
FIG. 5 demonstrates the invention including a pump-around that pumps a portion of the middle distillate oil fraction to a location in the vacuum tower above the middle distillate oil collection tray.

FIG. 5 demonstrates a pump-around 50 that pumps a portion 42 of the middle distillate oil fraction 28 to a location in the vacuum tower 24 above middle distillate oil collection tray 44. Like the wax oil collection tray, the middle distillate oil collection tray 44 collecting essentially all liquids on the tray to draw this off as middle distillate oil fraction 28. Pump-around 50 includes middle pump 52 that removes at least the portion 42 of the middle distillate oil fraction 28 and sends the portion through middle heat exchanger 54 before reintroducing the portion 42 to vacuum tower 24 above the middle distillate oil collection tray 44.

The process and apparatus of the invention product asphalt product 32 from the vacuum tower 24 that meets the specification for Performance Grade 76-22 without further additives. Thus, the asphalt product 32 is neat.

Finally, the asphalt product 32 is routed to storage or transferred to a hot mix plant where it is mixed with sand and rock to form a hot mix asphalt product suitable for use. The asphalt product or binder formed using the present invention will produce less "blue smoke" when processed at the hot mix plant. By reducing emissions from the binder, costs can be reduced through reduced emissions equipment.

It will be understood that certain features and subcombinations are of utility and may be employed without reference to other features and subcombinations. This is contemplated by and is within the scope of the claims.

Because many possible embodiments maybe made of the invention without departing from the scope thereof, it is to be understood that all matter herein set forth or shown in the accompanying drawings is to be interpreted as illustrative and not in a limiting sense.

We claim:

1. A process for separating a feed crude into fractional products comprising the steps of:

feeding the feed crude into a pre-flash vessel to produce therefrom an overhead light ends product and a liquid flashed crude feed;

introducing the flashed crude feed to a heater to produce a partially vaporized crude feed;

feeding the partially vaporized crude feed into a feed zone of a vacuum tower to produce from the vacuum tower an overhead vapor stream, a middle distillate oil fraction, a wax oil fraction, and a bottoms asphalt product; the feed zone being located below a wax oil collection tray that collect essentially all liquids on the wax oil collection tray into the wax oil fraction;

heating a portion of the wax oil fraction; and feeding the portion of the heated wax oil fraction into the feed zone.

2. The process of claim 1 further comprising the step of feeding the portion of the wax oil fraction into the heater in combination with the liquid flashed crude feed such that heating the portion of the wax oil fraction occurs in the heater.

3. The process of claim 1 further comprising the step of feeding the portion of the wax oil fraction into the pre-flash vessel in combination with the feed crude such that heating the portion of the wax oil fraction occurs in the heater.

4. The process of claim 1 further comprising the step of introducing the portion of the heated wax oil fraction into a second flash vessel prior to introduction into the feed zone.

5. The process of claim 1 wherein the feed crude is Boscan Crude.

6. The process of claim 1 wherein the feed crude is Altimira Crude.

7. The process of claim 1 wherein the asphalt product meets the specification for Performance Grade 76-22, the asphalt product being neat.

8. The process of claim 1 further comprising introducing steam into a bottom stripping section of the vacuum tower.

9. The process of claim 1 further comprising pumping a portion of the middle distillate oil fraction to a location in the vacuum tower above a middle distillate oil collection tray, the middle distillate oil collection tray collecting essentially all liquids on the middle distillate oil collection tray into the middle distillate oil fraction.

* * * * *